US008019478B2

(12) United States Patent
Whitehurst et al.

(10) Patent No.: US 8,019,478 B2
(45) Date of Patent: Sep. 13, 2011

(54) CONTROL SYSTEM AND METHOD FOR CONTROLLING MULTI-STAGE AIR CONDITIONERS

(75) Inventors: Michael D. Whitehurst, Cordele, GA (US); Jeff D. Brown, Vienna, GA (US)

(73) Assignee: Airxcel, Inc., Wichita, KS (US)

( * ) Notice: Subject to any disclaimer, the term of this patent is extended or adjusted under 35 U.S.C. 154(b) by 365 days.

(21) Appl. No.: 12/426,745

(22) Filed: Apr. 20, 2009

(65) Prior Publication Data

US 2010/0268397 A1 Oct. 21, 2010

(51) Int. Cl.
*G06F 19/00* (2011.01)

(52) U.S. Cl. ..... 700/276; 62/127

(58) Field of Classification Search ..... 700/276, 700/277, 282, 296, 299; 236/1 B, 93, 51; 62/158, 335, 175; 15/205
See application file for complete search history.

(56) References Cited

U.S. PATENT DOCUMENTS 5,027,789 A * 7/1991 Lynch ..... 126/116 A
5,816,059 A * 10/1998 Ficchi et al. ..... 62/127
6,101,824 A * 8/2000 Meyer et al. ..... 62/175
2005/0156050 A1* 7/2005 Shah et al. ..... 236/1 B
2005/0159847 A1* 7/2005 Shah et al. ..... 700/276
2007/0114291 A1* 5/2007 Pouchak ..... 236/44 C
2008/0251590 A1* 10/2008 Arneson ..... 236/1 B

* cited by examiner

*Primary Examiner* — Kidest Bahta
(74) *Attorney, Agent, or Firm* — Hovey Williams LLP

(57) ABSTRACT

A method of controlling operation of a pair of two-stage air conditioners. The method monitors a temperature of an area served by the air conditioners; activates a first stage of a first or lead air conditioner when the temperature rises above a first set point temperature; activates a first stage of a second or lag air conditioner when the temperature rises above a second set point temperature; activates a second stage of the first air conditioner only if the temperature remains above the second set point temperature beyond a first selected time period; and activates a second stage of the second air conditioner only if the temperature remains above the second set point temperature beyond a second selected time period. Neither of the air conditioners is operated in their less efficient second stages if both air conditioners are not first operating in their high efficiency first stages so that the entire cooling requirements of the area served by the air conditioners is primarily served by the first high efficiency stage of one or both the air conditioners.

20 Claims, 2 Drawing Sheets

CONTROL SYSTEM AND METHOD FOR CONTROLLING MULTI-STAGE AIR CONDITIONERS

BACKGROUND

The present invention relates to systems and methods for controlling the operation of multi-stage air conditioners. More particularly, the invention relates to such a system and method that achieves better temperature and humidity control and substantial energy savings.

Buildings and other areas with high internal heat loads, such as telecommunications equipment buildings, require cooling throughout the year even when outside temperatures are cold. Conventional residential and commercial air conditioners cannot be used for these applications because they are not designed for operation when outside temperatures are below 60° F. (15° C.). Therefore, air conditioning units that are engineered specifically for such applications with necessary controls, features, and safeties are required.

Telecommunications equipment buildings and other remote sites also typically require two or more redundant air conditioning units to provide necessary cooling in case one of the air conditioning units malfunctions. A thermostat controller may be used to operate the air conditioners in a lead/lag manner, where the start-up of the air conditioners is alternated so that both air conditioners experience approximately the same run-time over their lives.

To better match the cooling requirements of a building or other area with the operating performance of its air conditioning units, many newer high efficiency air conditioners are available with two-stage compressors. Such air conditioners may have, for example, a first stage that is 65% of the total compressor capacity, and a second stage that is 100% of the compressor capacity. When operating in their first stages, the air conditioners are approximately 20% more efficient than when operating in their second stages. Unfortunately, existing thermostat controllers do not properly control the operation of such high efficiency air conditioners to achieve maximum energy savings.

SUMMARY

The present invention provides a distinct advance in the art of air conditioning control systems and methods by providing such a system and method that achieves optimal temperature and humidity control and substantial energy savings. The invention achieves these goals by maximizing the run-time of two or more high efficiency air conditioners in their high efficiency first stages and operating them in their second stages only when required to meet high cooling requirements. In contrast, existing air conditioner control systems often operate one or more air conditioners in their lower efficiency second stages when it is not necessary to do so.

One embodiment of the invention is a method of controlling operation of a pair of two-stage air conditioners. The method monitors a temperature of an area served by the air conditioners; activates a first stage of a first or lead air conditioner when the temperature rises above a first set point temperature; activates a first stage of a second or lag air conditioner when the temperature rises above a second set point temperature; activates a second stage of the first air conditioner only if the temperature remains above the second set point temperature beyond a first selected time period; and activates a second stage of the second air conditioner only if the temperature remains above the second set point temperature beyond a second selected time period. Importantly, neither of the air conditioners is operated in its less efficient second stage until both air conditioners are operating in their high efficiency first stages. Thus, the entire cooling requirements of the area served by the air conditioners is initially and primarily served by the first high efficiency stages of the air conditioners.

Another embodiment of the invention is a cooling system comprising: a first two-stage air conditioner; a second two-stage air conditioner; and a control system for controlling operation of the first and second air conditioners to maintain a desired temperature range within a building or other area. The control system includes a thermostat controller; a first timer coupled with the thermostat controller; and a second timer coupled with the thermostat controller. The thermostat controller is operable to: monitor a temperature of the area; activate a first stage of the first air conditioner when the temperature rises above a first set point temperature; activate a first stage of the second air conditioner when the temperature rises above a second set point temperature; trigger the first timer when the first stage of the second air conditioner has been activated; activate a second stage of the first air conditioner if the temperature remains above the second set point temperature upon expiration of a countdown time period of the first timer; trigger the second timer when the second stage of the first air conditioner has been activated; and activate a second stage of the second air conditioner if the temperature remains above the second set point temperature upon expiration of a countdown time period of the second timer. Again, the thermostat controller does not activate the second, low efficiency stages of either air conditioner until both air conditioners are first operating in their first, high efficiency stages.

Thus, the present invention provides substantial energy savings and better control of the temperature and humidity in a building or other area by better matching the cooling requirements in the area with the operating performances of the air conditioners.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
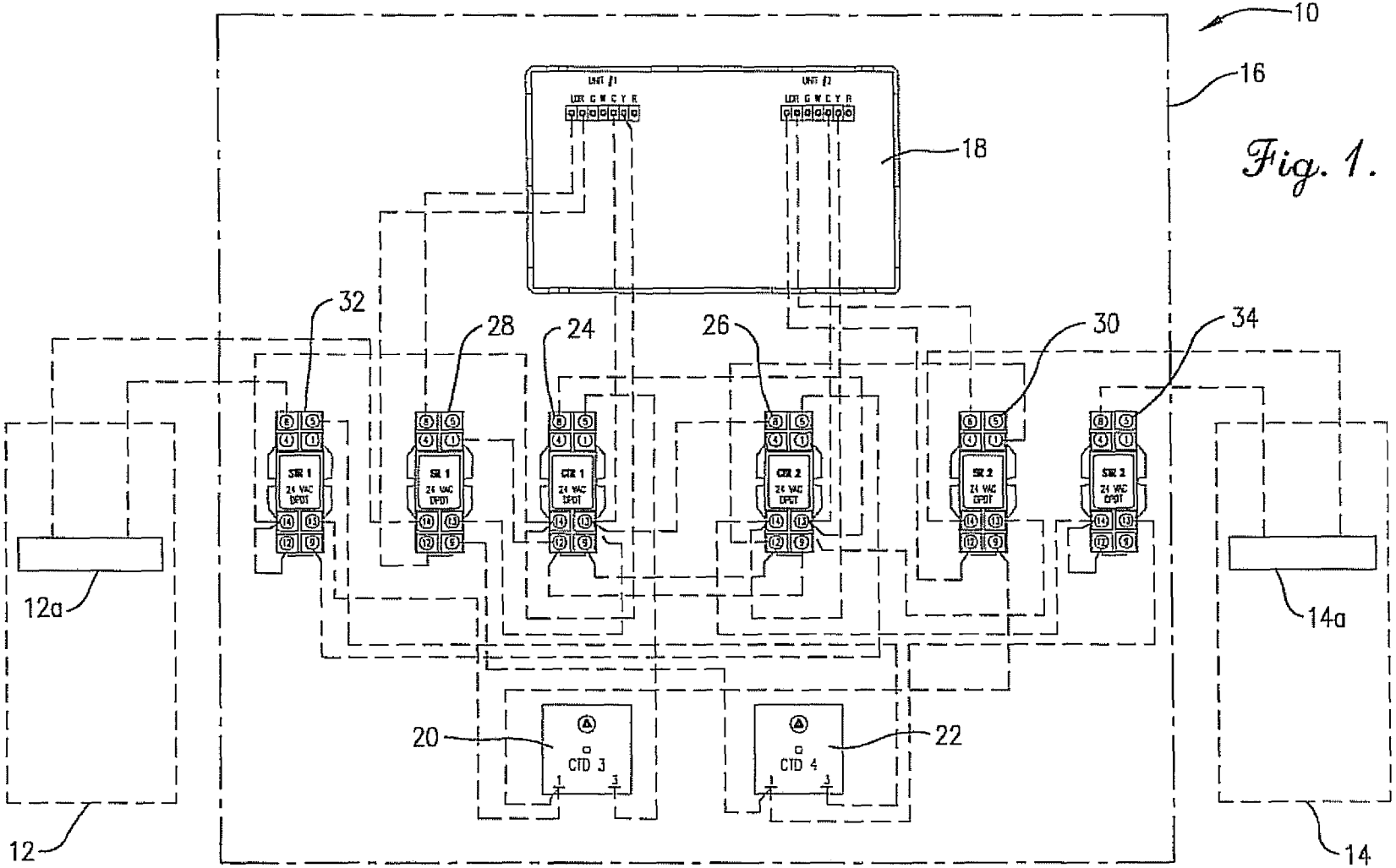
FIG. 1 is a schematic diagram of an air conditioning control system constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

The present invention provides a distinct advance in the art of air conditioning control systems and methods by providing a control system and method that achieves optimal temperature and humidity control and substantial energy savings. The invention achieves these goals by maximizing the run-time of two or more high efficiency air conditioners in their high efficiency first stages and operating them in their second stages only when required to meet high cooling requirements.

Turning now to the drawing figures, and particularly FIG. 1, a cooling system 10 constructed in accordance with an embodiment of the invention is illustrated. The cooling system 10 may be used to cool or otherwise maintain the temperature and/or humidity of any building, shelter, enclosure, or other area such as a building or shelter that houses telecommunications equipment. One embodiment of the cooling system 10 broadly comprises a first air conditioner 12, a second air conditioner 14, and a control system 16 for controlling operation of the air conditioners to maintain a desired temperature range within the area served by the air conditioners.

In more detail, the air conditioners 12, 14 may be any multi-stage air conditioners suitable for use with telecommunications equipment shelters and other applications that require cooling when outside ambient temperatures are below 60° F. In one embodiment, each of the air conditioners are Marvair® HVESA air conditioners having two-stage Copeland™ ZPS51K4E compressors. The air conditioners may have cooling capacities of 1-6 tons, EERs of up to 11.4, and may include hot gas reheat systems for dehumidification and economizers that use outside air for cooling when possible. The air conditioners may also be Marvair® ComPac® I or ComPac® II HVPSA or HVESA wall-mounted units or any other type or style of air conditioner. One of the air conditioners may be operated as the lead unit and the other as the lag unit, and such lead/lag designations may be periodically reversed to ensure equal wear on the units. For the following discussion, the first air conditioner 12 is considered the lead unit and the second air conditioner 14 is considered the lag unit.

Returning to FIG. 1, the control system 16 broadly comprises a thermostat controller 18, a pair of first and second compressor time delay timers 20, 22, a pair of compressor time relays 24, 26, a pair of switching relays 28, 30, and a pair of staged time relays 32, 34. The components of the control system 16 may be interconnected to one another and connected to wiring terminals 12*a*, 14*a* in the air conditioners 12, 14 as shown. The components of the control system may be interconnected by any wired or wireless connections and may be mounted in a sealed or otherwise protected enclosure.

The thermostat controller 18 is preferably a Marvair® CommStat™ 3 lead/lag controller designed to operate two air conditioners in a full or partially redundant air conditioning system, but it may be any other similar air conditioning controller. The thermostat controller 18 may be factory programmed to change the lead/lag status of the two air conditioners every seven days or may be field programmed to select a different lead/lag changeover schedule. The thermostat controller may also be factory or field programmed with a first set point temperature and a second set point temperature, the purpose of which is described below. In one embodiment, the first set point temperature may be 80° F. and the second may be 82° F., but any temperatures may be used. The thermostat controller 18 may also include conventional alarms, indicators, inputs, etc.

The thermostat controller 18 may be programmed with one or more computer programs that perform some of the functions described herein. The computer programs are stored in or on computer-readable mediums residing on or accessible by the thermostat controller 18. Each computer program comprises an ordered listing of executable instructions for implementing logical functions in the thermostat controller. The computer programs can be embodied in any computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electro-magnetic, infrared, or semi-conductor system, apparatus, device, or propagation medium contained in or accessible by the thermostat controller. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

The first and second timers 20, 22 may be any conventional timers such as those provided by ICM Corp. The timers are operable to count down any selected time periods, and in one embodiment are factory programmed for 5 minutes each. The timers can also be field programmed to select any other count-down time periods.

The compressor time relays 24, 26 may be any conventional relays such as 24 VAC DPDT relays provided by DEC. The compressor time relays are wired between the thermostat controller 18 and the first and second timers 20, 22 as shown in FIG. 1 and are provided to trigger the timers under the direction of the thermostat controller.

The switching relays 28, 30 may be any conventional relays such as 24 VAC DPDT relays provided by DEC. The switching relays and staged time relays are provided for activating the first and second stages of the air conditioners, respectively, when triggered to do so by the thermostat controller 18 and first and second timers 20, 22.

The above-described cooling system 10 may be used to implement a method of controlling operation of a pair of two-stage air conditioners such as the air conditioners 12, 14. In general, the method monitors a temperature of an area served by the air conditioners 12, 14; activates a first stage of the first or lead air conditioner 12 when the temperature rises above a first set point temperature; activates a first stage of the second or lag air conditioner 14 when the temperature rises above a second set point temperature; activates a second stage of the first air conditioner 12 only if the temperature remains above the second set point temperature beyond a first selected time period; and activates a second stage of the second air conditioner 14 only if the temperature remains above the second set point temperature beyond a second selected time period. Importantly, neither of the air conditioners 12, 14 is operated in its less efficient second stage until both air conditioners are operating in their high efficiency first stages. Thus, the entire cooling requirements of the area served by the air conditioners 12, 14 is initially and primarily served by the first high efficiency stages of the air conditioners. This results in substantial energy savings as described below, better matches the cooling requirements of the serviced area to the operational characteristics of the air conditioners 12, 14, and provides for lower start-up electricity demands, which is important when the air conditioners are powered by a generator.

Figure 2:
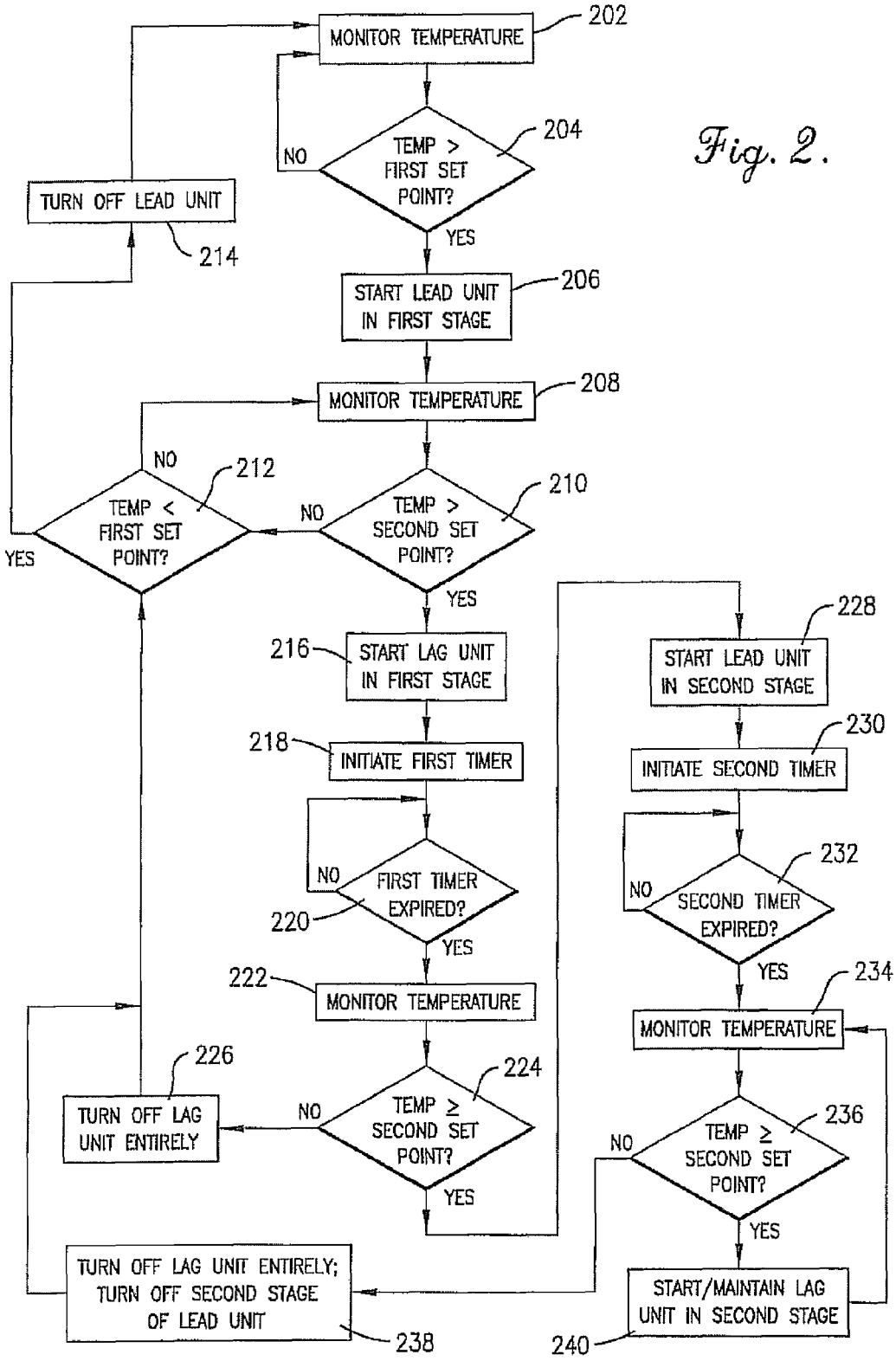
FIG. 2 is a flow diagram illustrating certain steps in a method in accordance with an embodiment of the invention.

The flow chart of FIG. 2 depicts the steps of an exemplary method of the invention in more detail. In this regard, some of the blocks of the flow chart may represent a module segment or portion of code of the computer programs stored in or accessible by the thermostat controller 18. In some alternative implementations, the functions noted in the various blocks may occur out of the order depicted in FIG. 2. For example, two blocks shown in succession in FIG. 2 may in fact be executed substantially concurrently, or the blocks may sometimes be executed in the reverse order depending upon the functionality involved.

As shown in FIG. 2, the control system 16 first monitors the temperature of the building, shelter, or other area served by the air conditioners 12, 14 as depicted in step 202. The temperature may be monitored by an internal thermostat of the thermostat controller or by an external thermostat that provides temperature readings to the thermostat controller. Although the flow chart of FIG. 2 shows several distinct steps where the temperature is monitored, the thermostat controller 18 may continuously or periodically monitor the temperature of the area served by the air conditioners at times other than those shown by the steps in FIG. 2.

The control system 16 next determines whether the current temperature of the area is greater than the first temperature set point as depicted in step 204. If it isn't, the method returns to step 202 and loops between steps 202 and 204 until the temperature exceeds the first temperature set point.

Once the monitored temperature exceeds the first temperature set point, the control system 16 starts the lead air conditioning unit 12 in its first stage as depicted in step 206. When in its first stage, the air conditioner 12 is operating in its most energy efficient mode as described above. The method then continues to step 208 where the temperature of the area is again monitored.

The control system 16 then determines whether the current temperature of the area is greater than the second temperature set point as depicted in step 210. If it isn't, that means the first stage of the first air conditioner 12 is maintaining the desired temperature range in the area by itself. The method thus proceeds to step 212 where the control system 16 determines whether the current temperature of the area is less than the first temperature set point. If it's not, that means additional cooling is required, so the method returns to step 208 to monitor the temperature and continue to operate only the lead air conditioning unit in its first stage.

If step 212 determines that the current temperature of the area is less than the first temperature set point, the control system turns off the lead air conditioning unit as depicted in step 214 because the first stage of the lead air conditioning unit successfully reduced the internal temperature of the area below the first temperature set point. At this point, no further cooling of the area is currently required.

However, if step 210 determines that the temperature of the area is greater than the second set point temperature, the method proceeds to step 216 where the control system 16 starts the lag air conditioning unit 14 in its first stage. This is done because the first stage of the lead unit 12 alone was not able to prevent the internal temperature of the area from rising above the second temperature set point. At this point, both air conditioners 12, 14 are operating, but only in their first high efficiency stages.

At generally the same time the first stage of the lag air conditioning unit is activated, the compressor time relay 24 initiates the first timer 20 as depicted in step 218. This begins a countdown of a first selected time period, which in one embodiment is 5 minutes. The method then determines if the first time period has expired as depicted in step 220. If it hasn't expired, the method loops back to step 220 until it does.

Once the first time period has expired, the control system 16 again monitors the temperature of the area as depicted in step 222. The control system then determines if the temperature of the area is greater than or equal to the second set point as depicted in step 224. If it is not, the control system turns off the lag unit 14 entirely as depicted in step 226 because it is no longer needed to maintain the temperature in the area below the second set point. The method then returns to step 212 to determine whether the lead air conditioning unit 12 also needs to be turned off as described above.

However, if step 224 determines that the temperature of the area is greater than or equal to the second temperature set point, the control system 16 starts the lead air conditioning unit 12 in its second stage as depicted in step 228. At generally the same time, the compressor time relay 26 initiates the second timer 22 as depicted in step 230. This begins a countdown of a second selected time period, which in one embodiment is 5 minutes. The method then determines if the second time period has expired as depicted in step 232. If it hasn't expired, the method loops back to step 232 until it does.

Once the second time period has expired, the control system 16 again monitors the temperature of the area as depicted in step 234. The control system then determines if the temperature of the area is greater than or equal to the second set point as depicted in step 236. If it is not, the control system turns off the lag unit 14 entirely and turns off the second stage of the lead air conditioning unit 12 as depicted in step 238. This is done because all of the current cooling requirements of the area can be met by the first stage of the first air conditioner alone. The method then returns to step 212 to determine whether the first stage of the lead air conditioning unit 12 also needs to be turned off as described above.

However, if step 236 determines that the temperature of the area is greater than or equal to the second set point, the control system 16 starts the second stage of the lag air conditioning unit 14 as depicted in step 240. This is done to provide maximum cooling to the area. The method then loops back to steps 234 and 236 to determine when and if the lead and lag air conditioners should be turned off as described above.

The control system 16 may also include a lockout mode. If either the lead 12 or the lag 14 air conditioning unit expresses a high or low pressure fault or other malfunction, it goes into a lockout mode and is no longer operational. The control system then bypasses the timer sequence described above and places the operational unit into its full capacity mode whenever cooling is called for by the thermostat controller 18. This ensures maximum cooling when only one air conditioner is operational. Once the lockout condition is resolved or reset, both the lead and lag units will return to the normal operation with the timing sequence as described above.

To demonstrate the potential energy savings achieved by the present invention, the cost to operate an embodiment of the cooling system 10 was compared to the cost to operate a conventional cooling system in a simulated test. The tested embodiment of the cooling system 10 included a pair of Marvair® HVESA air conditioners having two-stage Copeland™ ZPS51K4E compressors controlled by the control system described above. The tested embodiment of the conventional cooling system included a pair of Bard™ WA5S1 air conditioners having the same two-stage compressors as the tested embodiment of the present invention. The Bard™ air conditioners were controlled by a conventional four-stage thermostat controller that activated the air conditioners in the following order: the first stage of the first air conditioner, the second stage of the first air conditioner, the first stage of the second air conditioner, and finally the second stage of the second air conditioner.

The operation of both air conditioning systems was simulated in substantially identical conditions for a building having an internal mass of 3,000 lbm, an average internal specific heat of 0.5 btu/lbm° F., a solar and internal load of 55,000 btuh, and an electricity cost of $0.11 per KWH.

The tested embodiment of the present invention had a 24-hour cumulative cooling of 1,319,733 btu, a cumulative 24-hour energy use of 109.07 KWH, an average EER of 12.10, and a 24-hour energy cost of $12. The tested embodiment of the conventional air conditioning system had a 24-hour cumulative cooling of 1,320,000 btu, a cumulative 24-hour energy use of 129.43 KWH, an average EER of 10.20, and a 24-hour energy cost of $14.24. Thus, in this simulated example, the cooling system 10 of the present invention achieved a cost savings of $2.24 in a 24-hour period. The actual energy savings in a real-world application could be more or less depending on many factors including the characteristics of the building or other area served by the system.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A method of controlling operation of a pair of two-stage air conditioners that both serve a same area to be cooled, the method comprising:

monitoring a temperature of the area served by the air conditioners;

activating a first stage of a first one of the air conditioners when the temperature rises above a first set point temperature;

activating a first stage of a second one of the air conditioners when the temperature rises above a second set point temperature;

activating a second stage of one of the first or second air conditioners if the temperature remains above the second set point temperature beyond a first selected time period and only after the first stages of both the air conditioners have already been activated; and activating a second stage of the other one of the first or second air conditioners if the temperature remains above the second set point temperature beyond a second selected time period and only after the first stages of both the air conditioners have already been activated.

2. The method as set forth in claim 1, wherein the monitoring and activating steps are performed by a thermostat controller.

3. The method as set forth in claim 2, wherein the first and second set point temperatures can be programmed into the thermostat controller.

4. The method as set forth in claim 2, wherein the first selected time period is measured by a first timer coupled with the thermostat controller.

5. The method as set forth in claim 2, wherein the second selected time period is measured by a second timer coupled with the thermostat controller.

6. The method as set forth in claim 1, wherein the first stage of each air conditioner is a low capacity, high efficiency stage.

7. A cooling system comprising:

a first two-stage air conditioner;

a second two-stage air conditioner; and a control system for controlling operation of the first and second air conditioners to maintain a desired temperature range within an area served by both the first and second air conditioners, wherein the control system is operable to:

monitor a temperature of an area served by the first and second air conditioners;

activate a first stage of the first air conditioner when the temperature rises above a first set point temperature;

activate a first stage of the second air conditioner when the temperature rises above a second set point temperature;

activate a second stage of one of the first or second air conditioners if the temperature remains above the second set point temperature beyond a first selected time period and only after the first stages of both the air conditioners have already been activated; and activate a second stage of the other of the first or second air conditioners if the temperature remains above the second set point temperature beyond a second selected time period and only after the first stages of both the air conditioners have already been activated.

8. The cooling system as set forth in claim 7, wherein the control system includes a thermostat controller.

9. The cooling system as set forth in claim 8, wherein the first and second set point temperatures can be programmed into the thermostat controller.

10. The cooling system as set forth in claim 8, wherein the control system includes a first timer coupled with the thermostat controller for measuring the first selected time period.

11. The cooling system as set forth in claim 8, wherein the control system includes a second timer coupled with the thermostat controller for measuring the second selected time period.

12. The cooling system as set forth in claim 7, wherein the first stage of each air conditioner is a low capacity, high efficiency stage.

13. A cooling system comprising:

a first two-stage air conditioner;

a second two-stage air conditioner; and a control system for controlling operation of the first and second air conditioners to maintain a desired temperature range within an area served by both the first and second air conditioners, the control system comprising:

a thermostat controller;

a first timer coupled with the thermostat controller; and a second timer coupled with the thermostat controller;

the thermostat controller being operable to monitor a temperature of the area; activate a first stage of the first air conditioner when the temperature rises above a first set point temperature; activate a first stage of the second air conditioner when the temperature rises above a second set point temperature; trigger the first timer when the first stage of the second air conditioner has been activated; activate a second stage of the first air conditioner if the temperature remains above the second set point temperature upon expiration of a countdown time period of the first timer and only after the first stages of both the air conditioners have already been activated; trigger the second timer when the second stage of the first air conditioner has been activated; and activate a second stage of the second air conditioner if the temperature remains above the second set point temperature upon expiration of a countdown time period of the second timer and only after the first stages of both the air conditioners have already been activated.

14. The cooling system as set forth in claim 13, wherein the thermostat controller is programmable.

15. The cooling system as set forth in claim 14, wherein the first and second set point temperatures can be programmed into the thermostat controller.

16. The cooling system as set forth in claim 13, wherein the control system further includes a pair of timer relays wired between the thermostat controller and the first and second timers for triggering the first and second timers.

17. The cooling system as set forth in claim 13, wherein the control system further includes a pair of switching relays wired to the thermostat controller for activating the first stages of the first and second air conditioners.

18. The cooling system as set forth in claim 13, wherein the control system further includes a pair of staged time relays wired to the thermostat controller for activating the second stages of the first and second air conditioners.

19. The cooling system as set forth in claim 13, wherein the first stage of each air conditioner is a low capacity, high efficiency stage.

20. The cooling system as set forth in claim 13, wherein the area served by the air conditioners is a telecommunications equipment shelter.

* * * * *